United States Patent [19]

Lefevre et al.

[11] Patent Number: 4,815,435

[45] Date of Patent: Mar. 28, 1989

[54] PROCESS FOR CORRECTING THE RICHNESS OF AN AIR-FUEL MIXTURE ADMITTED INTO AN INTERNAL COMBUSTION ENGINE WITH ELECTRONIC INJECTION

[75] Inventors: Rémi Lefevre, Paris; Jean-Pierre Lagrue, Rueil-Malmaison, both of France

[73] Assignee: Regie Nationale des Usines Renault, Boulogne Billancourt, France

[21] Appl. No.: 107,998

[22] Filed: Oct. 14, 1987

[30] Foreign Application Priority Data

Oct. 14, 1986 [FR] France ..... 86 14252

[51] Int. Cl.[4] ..... F02D 41/14

[52] U.S. Cl. ..... 123/489; 123/478; 123/494

[58] Field of Search ..... 123/440, 478, 480, 488, 123/489, 491, 494

[56] References Cited

U.S. PATENT DOCUMENTS

| | | | |
|---|---|---|---|
| 2,910,054 | 10/1959 | Schutte | 123/484 |
| 3,824,967 | 7/1974 | Gordon | 123/485 |
| 4,465,051 | 8/1984 | Hasegawa | 123/478 X |
| 4,495,925 | 1/1985 | Hasegawa | 123/480 |
| 4,499,879 | 2/1985 | Stoltman et al. | 123/478 X |
| 4,594,986 | 6/1986 | Shimoda et al. | 123/478 X |
| 4,719,890 | 1/1988 | Wataya et al. | 123/494 X |

*Primary Examiner*—Tony M. Argenbright

*Attorney, Agent, or Firm*—Oblon, Fisher, Spivak, McClelland & Maier

[57] ABSTRACT

Process for correcting the richness of an air-fuel mixture admitted into an internal combustion engine with electronic ignition of the pressure-speed type, to obtain a constant richness as a function of the air temperature entering the cylinders, wherein the correction is of the multiplicative type:

$$T_i = T_{in}\,(1+(\alpha_{air})/256)$$

$$\alpha_{air} = f(T')$$

$$T' = T + k(T_{water} - T)$$

$$k = k_1(N) + k_2(P) + k_3$$

wherein:

$\alpha_{air}$ is term of correction of the richness as a function of the air temperature T' actually entering the cylinders;

T is the temperature of the air measured by the injection computer; and $T_{water}$ is the water temperature of the engine.

2 Claims, 3 Drawing Sheets

PROCESS FOR CORRECTING THE RICHNESS OF AN AIR-FUEL MIXTURE ADMITTED INTO AN INTERNAL COMBUSTION ENGINE WITH ELECTRONIC INJECTION

BACKGROUND OF THE INVENTION

1. Field of the Invention

The invention relates to a process for correcting the richness of an air-fuel mixture admitted into an internal combustion engine with electronic injection of the pressure-speed type, to keep the richness constant as a function of the air temperature entering the cylinders and regardless of the speed and pressure in the intake manifold.

2. Discussion of the Background

For an injection engine of the pressure-speed type which comprises a computer for controlling the opening of the injectors, but lacking a probe for measuring the richness of the exhaust gases making it possible to control the richness of the mixture at the intake to the latter, difficulties appear during adjusting of the correction of richness as a function of the air temperature. In particular, a change in the richness during extended idle speeds is found.

A study of the influence of certain parameters such as the water temperature of the engine, the pressure in the intake manifold or the engine speed, on the heating of air at the intake between the place where its temperature is measured by a probe placed upstream from the throttle butterfly and the valves have made it possible to obtain a law of heating the air that eliminates said drawbacks.

SUMMARY OF THE INVENTION

The object of the invention is to correct the richness of the air-fuel mixture at the intake so that it is constant as a function of the actual temperature of the air entering the cylinders.

For this purpose, the object of the invention is to provide a process for correcting the richness of an air-fuel mixture admitted into an internal combustion engine with electronic injection of the pressure-speed type to obtain a constant richness as a function of the air temperature entering into cylinders, regardless of the speed and manifold pressure, the engine being equipped with a computer controlling opening time $T_i$ of the injectors, a temperature probe placed upstream from the throttle butterfly of the gases and a water temperature probe of the engine, characterized in that the correction is of the multiplicative in accordance with the formula:

$$T_i = T_{in}(1+\alpha_{air}/256)$$

with:

$$\alpha_{air} = f(T')$$

$$T' = T + k(T_{water} - T)$$

$$k = k_1(N) + k_2(P) + k_3$$

wherein:

- $T'$ is temperature of the air actually entering the cylinders;
- $T$ is temperature of the air measured by the computer;

- $T_{water}$ is water temperature of the engine;
- $k_1$ is a function coefficient of the engine speed, obtained by interpolation in a table of x points;
- $k_2$ is a coefficient representing the influence of the manifold pressure, obtained by linear interpolation in a table of x points;
- $k_3$ is a constant coefficient characteristic of the engine intake;
- $\alpha_{air}$ is the term of correction of the richness as a function of the air temperature.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

As has been said before, correcting the richness of the air-gasoline mixture, currently performed in an injection system of the pressure-speed type, as a function of the air temperature uses the measurement of this temperature by a probe placed upstream from the throttle butterfly case. Now, it has been found that this correction was unsuited for certain points of operation of the engine, particularly when the air underwent a heating between the throttle butterfly and the valves. The technical problem comes from the fact that the probe for measuring the air temperature does not deliver the actual temperature of the air entering the cylinders.

Between the throttle butterfly and the intake valves, the air is heated by the walls of the intake manifold. Heat exchange take place between the air circulating in the manifold and the walls and, theoretically, it can be said that the temperature of the air at the entrance of the intake manifold undergoes a rise as a function of the temperature of the walls, the pressure of the air in the manifold and the engine speed on which the amount of air admitted depends.

According to the invention, the temperature $T'$ of the air admitted into the cylinders of the engine has the form:

$$T' = T + k(T_{water} - T)$$

with:

$$k = k_1(N) + k_2(P) + k_3 \quad 0 \leqq k \leqq 1$$

- $T$ being the temperature measured by the probe placed upstream from the throttle butterfly,
- $T_{water}$ being the temperature of the water of the engine,
- $k_1$ being a function coefficient of the engine speed,
- $k_2$ being a coefficient representing the influence of the manifold pressure, $k_3$ being a coefficient characteristic of the engine intake.

Figure 1:
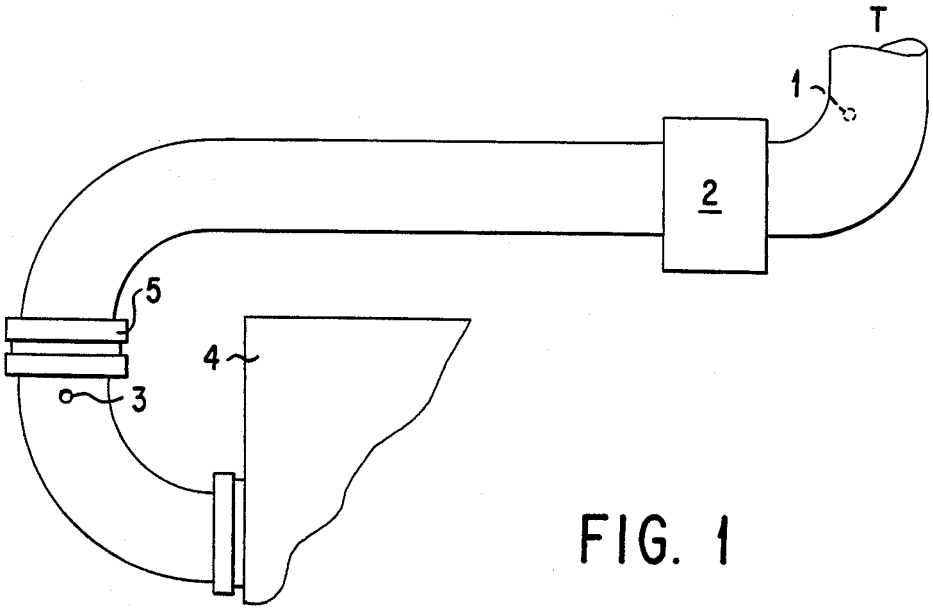
FIG. 1 illustrates the installation of the thermocouples on the engine for the verification of the law of heating of the air temperature.
Figure 2:
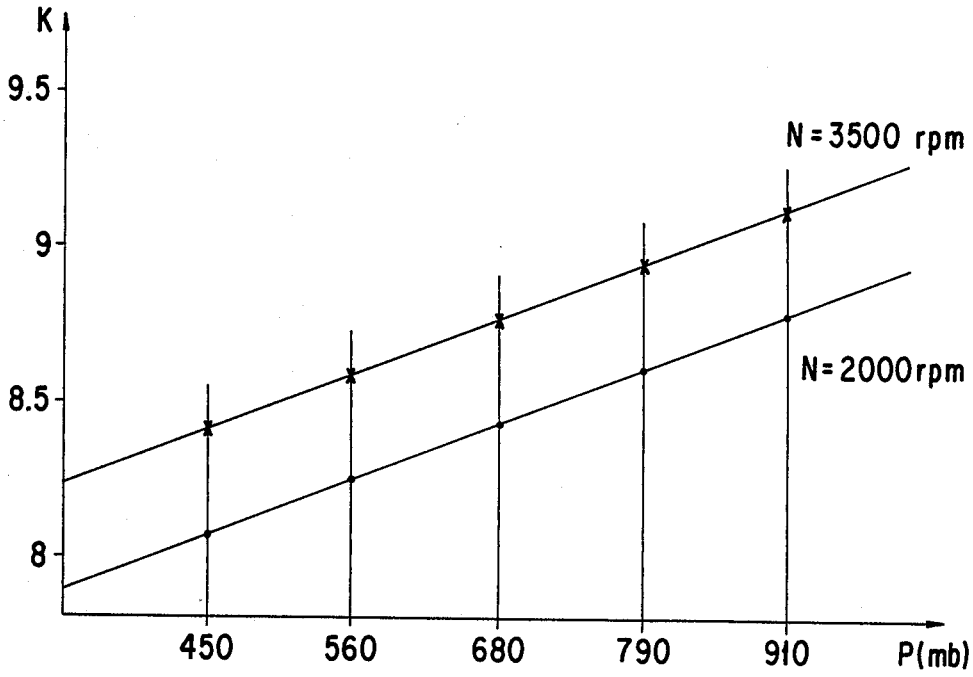
FIG. 2 shows the variations of coefficient k as a function of the manifold pressure.

FIG. 1 shows the installation of thermocouples on the intake circuit of the engine, placed closest to the values to verify the precision of the formula of the temperature thus computed. Temperature T of the outside air is given by a probe 1 upstream from throttle butterfly 2. A thermocouple 3 placed in the center of the intake duct, downstream from the throttle butterfly and near cylinder head 4, makes it possible to compare air temperature T measured by the computer with the temperature that it delivers and which is very close to that of the air entering the cylinder head. A thermocouple 5 makes it possible to verify that the temperature of the wall of the intake circuit is very close to that of the water $T_{water}$ given by a water temperature probe. In particular, it is verified that for high speeds and pressures, the temperature of the air actually entering the cylinders is very close to that of the outside air of the vehicle. This is explained by the fact that the air admitted does not have the time to be heated along the walls, its flow being relatively great. On the other hand, for idling of the engine, the actual temperature of the air entering through the valves is close to the temperature of the cooling water of the engine.

Thanks to the probes and thermocouples placed on the intake circuit of the engine, the values of coefficient k have been deduced. It can be noted that, for a given speed N, k is a linear function of the pressure.

Thanks to this new computation of the temperature of the air actually admitted, it is possible to achieve a regulation of richness of the air-fuel mixture which does not exhibit any drift at certain points of operation of the engine. By introducing this law of heating of the air between the throttle butterfly case and the valves into the injection computer, the richness is corrected so as to keep it constant as a function of the air temperature. For this purpose, the computer controls an opening time $T_1$ of the injectors of the form:

$$T_1 = T_{in}(1+\alpha_{air}/256) \quad (1)$$

with:

$$\alpha_{air} = f(T')$$

$$T' = T + k(T_{water} = T) \quad (2)$$

$$k = k_1(N) + k_2(P) + k_3 \quad (3)$$

where:

$T_{in}$ is the nominal opening time computed in a standard way as a function of the principal and auxiliary parameters of operation of the engine;

$\alpha_{air}$ is the term of correction of the richness as a function of the air temperature.

This process of correction of the richness has the advantage of being easily applied by the injection computer, since it involves a linear computation from data present in the injection computer (water and air temperatures, engine speed, pressure).

The invention can also be applied to an electronic injection engine being regulated by a Lambda probe. This closed-loop regulation of the injection makes it possible to control the richness of the air-fuel mixture admitted into the engine around the stoichiometric ratio ($\lambda = 1$), which is an essential condition for the satisfactory combustion of the pollutants by a catalyst. Its good operation requires a precise and rapid regulation of the mixture. The process of correcting the richness according to the invention makes it possible to obtain this precision and this rapidity. Experimentally, the engine being equipped with a Lambda probe and looping at richness 1 being performed at idling, with no other correction of richness, the following evolution of the looping coefficient $\alpha_{c1}$ can be observed:

during the rise in temperature of the cooling water of the engine $T_{water}$ is from 0° C. to 90° C.;

at constant water temperature $T_{water}$, the outside air temperature T can vary from 0° C. to 20° C.;

at constant air temperature T, there exists a variable water temperature $T_{water}$.

It is noted that looping coefficient $\alpha_{c1}$ remains constant when the outside air temperature varies, which justifies the use of an air temperature constant at idling in certain engines, and that this coefficient $\alpha_{c1}$, on the other hand, changes with the water temperature of the engine.

It is thereby concluded that the temperature of the air entering the engine at idling is close to the water temperature of the engine and, therefore, does not depend on the temperature of the outside air. Therefore, $k=1$ can be selected at idling and, secondly, that the change of looping coefficient $\alpha_{c1}$ during the rise in temperature of the water of the engine corresponds to the correction of richness as a function of the temperature of the air.

Figure 3A:
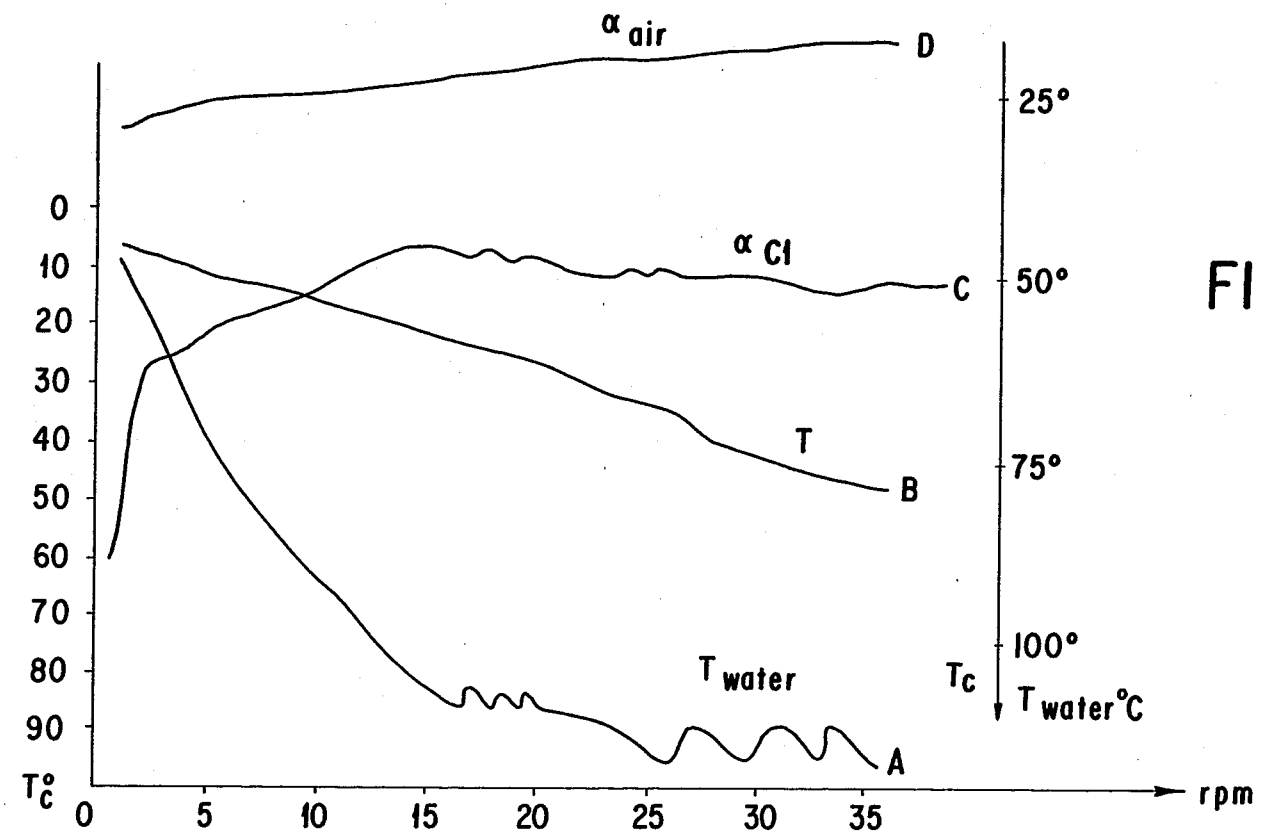
FIGS. 3*a* and 3*b* illustrate the evolution of certain parameters of the engine equipped with a λ probe for a loop at richness 1, respectively with and without the new law of heating.
Figure 3B:
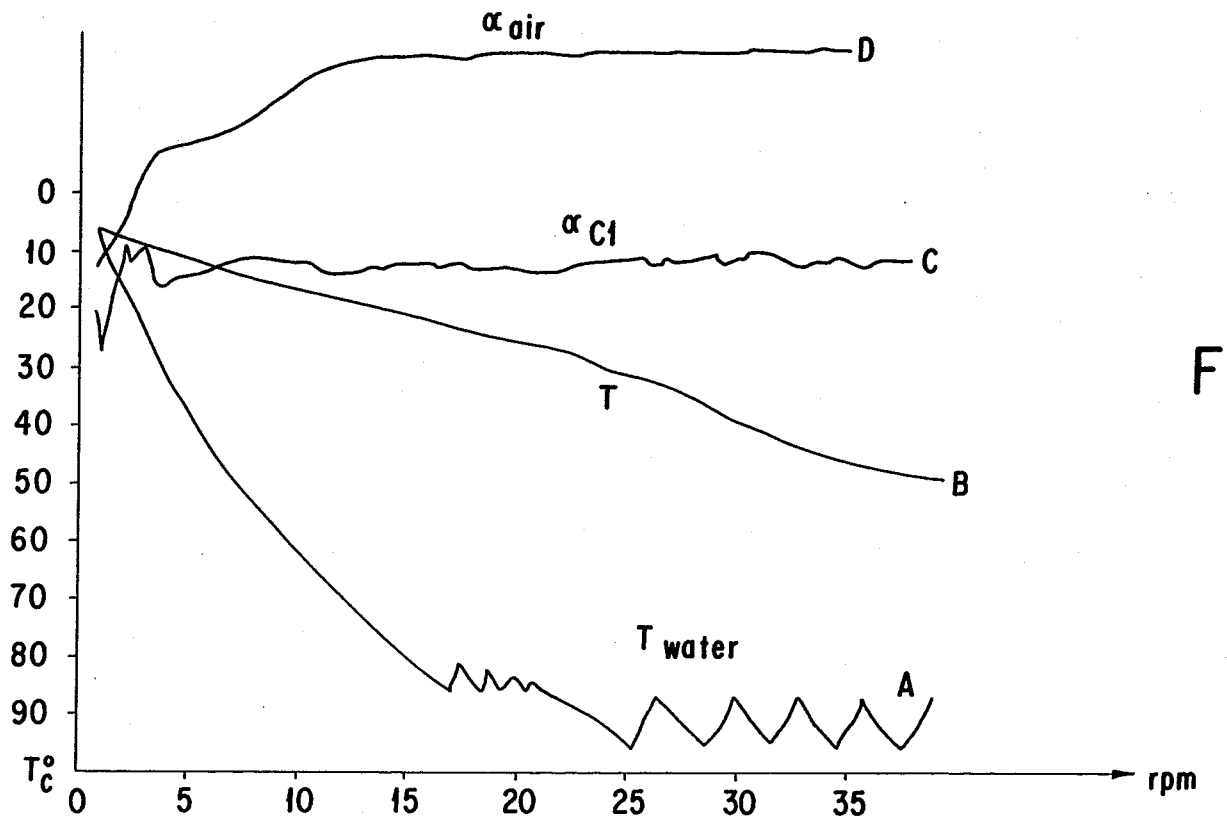

In FIG. 3*a*, represented as a function of time t are cooling water temperature $T_{water}$ of the engine (curve A), outside air temperature T (curve B), looping coefficient $\alpha_{c1}$ (curve C) and the coefficient of correction of richness $\alpha_{air}$ as a function of the temperature of the air (curve D), without application of the process of correction according to the invention. By having selected $k=1$ since the engine is at idling and with a richness equal to 1 because of the $\lambda$ probe, it is seen that coefficient $\alpha_{c1}$ is a function of water temperature $T_{water}$ and that such decreases when the latter increases. By introducing this law of correction without looping by the probe, i.e., by causing coefficient $\alpha_{air}$ to vary as a function of the air temperature as $\alpha_{cl}$ varied as a function of $T_{water}$ in FIG. 3*a*, and by remaining under the conditions of idling, it is observed that looping coefficient $\alpha_{c1}$ remains constant at idling from the starting of the engine regardless of the idling time. This is shown in FIG. 3*b* referenced like FIG. 3*a*.

Thus, when $k=1$ at idling, it is possible to know the law $\alpha_{air}=f(T')$ of correction of richness, a unique law if it is considered that T' is the actual air temperature entering the cylinders. The knowledge of this law of correction of richness makes it possible to identify coefficient k for each point of operation of the engine, without the necessity of thermocouples being available at certain points of the engine, and therefore coefficients $k_1$, $k_2$, and $k_3$.

Obviously, numerous modifications and variations of the present invention are possible in light of the above teachings. It is therefore to be understood that within the scope of the appended claims, the invention may be practiced otherwise than as specifically described herein.

We claim:

1. A process for correcting the richness of an air-fuel mixture admitted into an internal combustion engine with electronic injection of the pressure-speed type, to obtain a constant richness as a function of the air temperature entering the cylinders, regardless of the speed and manifold pressure, the engine being equipped with a computer controlling the opening time $T_i$ of the injectors, a temperature probe placed upstream from the throttle butterfly of the gases and a water temperature probe of the engine, said process including the step of correcting the opening time $T_i$ in accordance with the formula:

with $$T_i - [T_{inom}]T_{in}(1+(\alpha_{air}/256)$$

$$\alpha_{air}=f(T')$$

$$T'=T+k(T_{water}-T)$$

$$k=k_1(N)+k_2(P)+k_3$$

wherein:

$T'$ is the temperature of the air actually entering the cylinders;

$T$ is the temperature of the air measured by the computer;

$T_{water}$ is the water temperature of the engine;

$k_1$ is a function coefficient of the engine speed;

$k_2$ is a coefficient representing the influence of the manifold pressure;

$T_{in}$ is the nominal opening time of the injectors;

$P$ is the manifold pressure;

$N$ is engine speed;

$k_3$ is a coefficient characteristic of the engine intake; and $\alpha_{air}$ is the term of correction of the richness as a function of the air temperature.

2. The process of claim 1, including the step of regulating the richness with an oxygen probe.

* * * * *